United States Patent [19]

Schapira et al.

[11] Patent Number: 4,497,666

[45] Date of Patent: Feb. 5, 1985

[54] PROCESS FOR THE TREATMENT OF PHOSPHATIZED METAL SURFACES WITH A COMPOSITION COMPRISING TRIVALENT TITANIUM

[75] Inventors: Joseph Schapira, Paris; Victor Ken, Colombes; Jean-Loup Dauptain, Aulmoye-Aymeries, all of France

[73] Assignee: Compagnie Francaise De Produits Industriels, Gennevilliers, France

[21] Appl. No.: 462,088

[22] Filed: Jan. 28, 1983

[30] Foreign Application Priority Data

Jan. 29, 1982 [FR] France ..... 82 01476

[51] Int. Cl.[3] ..... C23C 1/10; C23F 7/08

[52] U.S. Cl. ..... 148/6.15 R; 148/6.15 Z; 427/327; 427/419.1

[58] Field of Search ..... 427/327, 343, 388.1, 427/399, 409, 435, 436, 419.1, 419.7, 405; 148/6.15 R, 6.15 Z, 6.16

[56] References Cited

U.S. PATENT DOCUMENTS 2,970,935 2/1961 Cavanagh ..... 148/6.16
3,519,494 7/1970 Engesser et al. ..... 148/6.15 R
4,130,431 12/1978 Kogure ..... 148/6.15 R
4,165,242 8/1979 Kelly et al. ..... 427/409
4,233,088 11/1980 Kronstein ..... 148/6.15 R
4,281,037 7/1981 Choung ..... 427/409

*Primary Examiner*—Sadie L. Childs
*Attorney, Agent, or Firm*—Fleit, Jacobson, Cohn & Price

[57] ABSTRACT

The invention relates to a composition and a process for the treatment, more precisely the "post-treatment" of phosphatized metal surfaces, particularly when the surfaces must be subsequently covered with a coat of paint. It relates also to a process for the preparation of the composition and a concentrate useful for this preparation. The composition comprises an effective proportion of trivalent titanium compound and it is presented with an acid pH, the proportion of said compound being sufficient for the corresponding composition to confer on the treated metal surface a protection equivalent to that obtained with known chromatizing solutions. More particularly, the composition contains trivalent titanium at a concentration of 0.01 to 2 g/l, preferably from 0.2 to 0.6 g/l and has a pH of 2 to 7. Reducing means can be arranged to regenerate the trivalent titanium in the treatment solution continuously.

4 Claims, 2 Drawing Figures

PROCESS FOR THE TREATMENT OF PHOSPHATIZED METAL SURFACES WITH A COMPOSITION COMPRISING TRIVALENT TITANIUM

FIELD OF THE INVENTION

The invention relates to a composition and process for the treatment, more precisely the "post-treatment" of phosphatized metal surfaces, particularly when the surfaces must be subsequently covered with a coat of paint.

It relates also to a process for the preparation of the composition and to a concentrate useful for this preparation.

Phosphatizing, particularly phosphatizing with iron and with zinc, of the metal surfaces concerned, that is to say of surfaces of substrates based on iron, steel, zinc, galvanized iron and steel, alunimium and alloys of the foregoing metals, on cadmium and the like, is for the purpose of protecting these surfaces against corrosion. These surfaces are, if necessary, then covered with a layer of paint which may be based more particularly on lacquers, varnishes and enamels applied, for example, by dipping, electrophoresis, spray gun and the like.

PRIOR ART

There already exist treatments of phosphatized metal surfaces, currently called passivating rinses or post-treatment rinses.

These treatments, which have the purpose of further increasing the effectiveness of the protection against corrosion of the previously phosphatized metal surfaces, generally employ trivalent and/or hexavalent chromium ions in the form of chromatizing compositions or solutions based on chromate applied in a final or passivating rinse.

Whilst giving satisfaction from the point of view of the improvement thus realised in the protection against corrosion, these treatments have none the less two major drawbacks residing, in order of importance, in the high toxicity—due to the trivalent and hexavalent chromium ions—of the chromatizing solutions employed and of the subsequent effluents imposing the need for treatment to remove the troublesome ions.

in the strong coloration manifested by visible yellow stains if the subsequently applied paint layer is thin.

Numerous attempts have sought to replace the chromatizing treatment by treatments based on chromium-free compositions.

Thus it has been proposed to apply to the previously phosphatized surfaces, in particular compositions containing soluble salts of zirconium, compositions containing fluorinated salts of calcium, zinc, aluminum, tetravalent titanium, zirconium, nickel, compositions containing tetravalent titanium in the form of potassium or ammonium fluotitanate or potassium and titanyl oxalate.

Although these treatments have enabled the drawbacks due to the chromium iron and inherent in compositions containing it, to be eliminated, they have not given entire satisfaction by reason of the fact that the protection against corrosion that they confer on the treated surfaces, was very distinctly inferior so that produced by means of chromatizing compositions.

GENERAL DESCRIPTION OF THE INVENTION

Is therefore a particular object of the invention to provide a composition and a process for the treatment of phosphatized metal surfaces which, whilst confering on these surfaces a protection equivalent to that produced by the chromatizing solutions of the prior art, no longer present the drawbacks of the latter.

Applicants have now had the merit of discovering, quite unexpectedly, that whilst prior art treatments employing tetravalent titanium had not been satisfactory from the point of view of the protection confered, treatment by means of a composition based on a trivalent titanium compound and chromium-free, conferred on the metal surfaces treated, a protection equivalent to that produced with the chromatizing solutions of the prior art.

It follows that the treatment composition according to the invention is characterised by the fact that it comprises an effective proportion of trivalent titanium compound and that it is presented with an acid pH, it being understood that, by the expression "effective proportion", is meant the proportion of compound sufficient for the corresponding composition to confer on the treated metal surface a protection equivalent to that obtained with known chromatizing solutions.

More particularly, the composition according to the invention contains trivalent titanium at a concentration of 0.01 to 2 g/l, preferably from 0.2 to 0.6 g/l and has a pH of 2 to 7.

More particularly still, the composition is presented in the form of a concentrate which can contain, by way of indication, about 10 to 50 g of trivalent titanium per liter, this concentrate, which is kept preferably sheltered from the oxygen of the air until the moment of use, being diluted at this moment with the amount of water preferably distilled or deionized, selected to result in the effective concentration of trivalent titanium in the final composition.

The treatment process according to the invention is characterised by the fact that, in a process for phosphatizing of metal surfaces and before the possible application of a paint layer, the phosphatized metal surfaces is treated by contacting said surface with a composition according to the invention, the duration of contact having to be sufficient to confer on the treated surface the desired resistance to corrosion.

More particularly, the treatment takes place by static or dynamic dipping of the metal surface to be treated, in the composition according to the invention, the duration of immersion being from 10 to 60 seconds and the temperature of the composition less than 90° C., preferably comprised between 18° and 60° C.

The relatively low stability, particularly in dilute solution and in contact with the oxygen of the air of the compounds containing trivalent titanium which is oxidized rapidly into tetravalent titanium, requires the composition according to the invention to be prepared generally at the moment of use and regenerated if necessary in the course of operating by reduction of the tetravalent titanium formed to trivalent titanium.

According to a particular aspect, the process of preparing the composition according to the invention is hence characterised by the fact that the trivalent titanium is prepared in situ and before the application of the composition of the phosphatized metal surfaces, by contacting tetravalent titanium with a reducing means, the composition being then, in the course of the process of the treatment of phosphatized surfaces, regenerated into trivalent titanium by contacting, particularly a fraction drawn from the composition, with the above-said reducing means so that the concentration of the composition in trivalent titanium compound is kept to the effective proportion, particularly from 0.2 to 0.6 g of trivalent titanium per liter above-mentioned.

According to another aspect, the above-said process of preparation of the composition according to the invention is characterised by the fact that recourse is had to the concentrate according to the invention and that the concentration of the trivalent titanium of the composition so obtained is kept to the effective value by regeneration in the course of operation in contact with a reducing means for the tetravalent titanium into trivalent titanium.

The above-said regeneration can take place continuously.

The invention will be still better understood with the aid of the additional description and of the following examples which additional description and examples are given in respect of advantageous embodiments.

DESCRIPTION OF PREFERRED EMBODIMENTS

Figure 1:
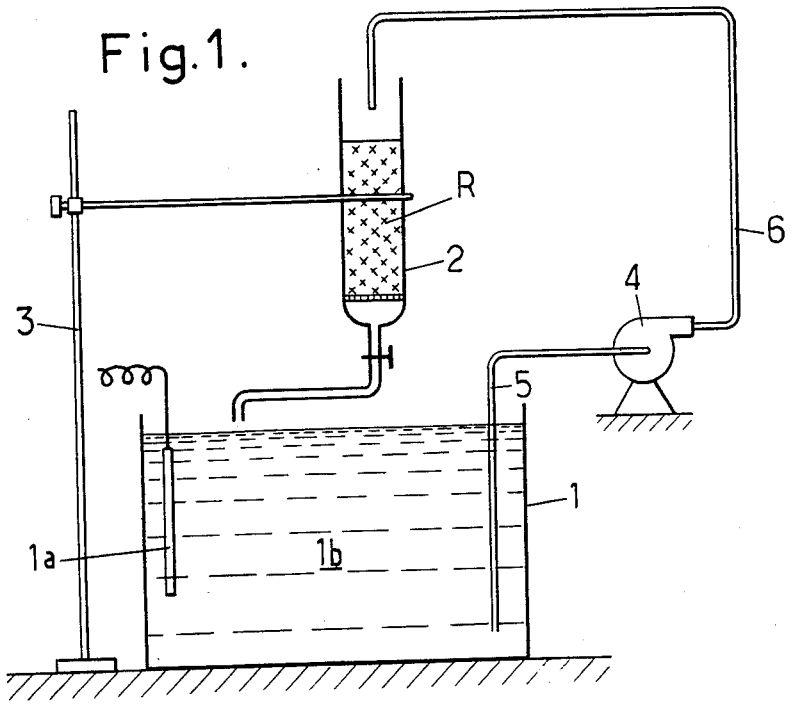

In order, consequently, to treat, for the purpose of improving its resistance to corrosion, a phosphatized metal surface which has possibly to receive subsequently one or several paint layers, procedure is as follows or in equivalent manner.

First of all and in manner known in itself, said metal surface which may be that of a metal substrate based on iron, steel, zinc, galvanized iron or steel, aluminum, alloys of these metals, of cadmium and the like, is subjected to a phosphatizing treatment comprising after degreasing by means particularly of alkaline washes, the action of a conventional acid phosphatizing composition with iron or with zinc generally employed hot and for several minutes by dipping or by spraying.

After rinsing, particularly with tap water and then with deionised water, the metal surface is treated with the composition according to the invention.

The latter contains a trivalent titanium compound at an effective concentration, particularly from 0.01 to 2 g, preferably from 0.2 to 0.6 g of trivalent titanium per liter and has an acid pH, particularly from 2 to 7, preferably from 2 to 5.

The proportions from 0.2 to 0.6 g of trivalent titanium per liter correspond to a value of $4.17.10^{-3}$ to $1.25\times10^{-2}$ atom-grams of trivalent titanium per liter.

The pH may be adjusted by means of soda, ammonia, hydrofluoric acid, nitric acid and other acids or bases.

The composition is employed at a temperature below 90° C. and particularly selected within the range of 18° to 60° C.

The treatment takes place preferably by dipping the metal surface in the composition for a duration generally comprised between 10 and 60 seconds.

The composition can also be applied by spray; this technique is less advantageous by reason of the sensitivity of trivalent titanium with respect to oxidation.

The treatment is followed by rinsing with water and drying, particularly hot, of the metal surface before the possible application of a paint which can be selected from among lacquers varnishes, enamels and the like, applied by any suitable process.

The rinsing before the application of the paint enables the risk of blistering of the latter to be reduced.

The quality of the anti-corrosion protection conferred can be tested by the salt fog test which will be more particularly considered with respect to the examples. This test is described in the American standards ASTM B 117 and ASTM D 1654-61. The evaluation of the resistance to corrosion conferred is done by means of a scale rangingg from 0 (nil resistance) to 10 (very good resistance to corrosion).

The trivalent titanium compound may be selected from the group comprising the chloride, bromide, fluoride, oxalate and sulfate of trivalent titanium which were found to be particularly active.

Advantageously the composition according to the invention is prepared at the start in a form of a concentrate; by way of indication, it is pointed out that this concentrate can contain about 10 to 50 g of trivalent titanium per liter.

This concentrate which leads to the composition according to the invention by dilution with a suitable amount of water, preferably deionised to avoid the introduction of polluting agents such as magnesium and calcium, also contains the possible other constituents of the composition, namely particularly:

a small amount, particularly of the order of 0.001 to 0.02 g/l of surface active agents, particularly of the organic type such as sodium alkylsulfonates or ethoxylated hydrocarbons.

a small proportion, particularly from 1 mg/l to 500 mg/l of stabilizing agents, in particular such as pyrogallol or hydroquinone.

By reason of the sensitivity of the trivalent titanium with respect to the oxygen of the air, the above-said concentrate is kept sheltered from air until the moment of use.

This same sensitivity of trivalent titanium means that the composition according to the invention must be regenerated to keep at an effective value its concentration of trivalent titanium, which can be done by contacting with a reducing means, particularly a reducing agent.

From the practical point of view, it is possible to include in the treatment vessel containing the composition a branch pipe in which the reducing agent is placed.

If treatment by dipping is of the state type, it is possible to sample the composition at the bottom of the vessel, to pass it through the branch pipe containing the reducing agent and to reintroduce it at the surface of the bath constituting the composition.

If the dipping treatment is of the dynamic type with translation of the part comprising the phosphatised surfaces to be treated, it is advantageously arranged for the direction of the flow created with the composition, as a result of the taking up in the branch pipe, to be opposite to the translation movement of the parts.

The reducing means may be either a metallic or chemical reducing agent placed in a column, or an electrolysis cell, the column or the cell being traversed by the composition to be regenerated continuously or discontinuously so that the concentration of trivalent titanium is kept at the effective value; the effects of oxidation of the bath and/or of the regeneration are followed by simple oxidation-reducing volumetric determination and the regeneration is restarted or stopped when the proportion of the composition in trivalent titanium exceeds the limits indicated above.

The reducing agents used may be constituted:

when there are metallic reducing agents by solid zinc amalgam, by cadmium grains, by Raney metals, reduction being carried out in a hydrochloric or sulphuric acid medium (0.5 to 2N), when there are chemical reducing agents, by borohydrides or hypophosphites of alkali metals of the group comprising $NaBH_4$, $KBH_4$, $NaH_2PO_2$, $H_2O$; these agents are used hot and necessitate the presence of a catalyst; in particular then enable potassium fluotitanate ($K_2TiF_6$) to be converted into $TiF_3$.

When the reduction is carried out by means of electrolysis, an inert electrode is used, the process being that used in redox batteries.

Taking into account the foregoing description, it will be advantageous for the user to have available simultaneously, treatment composition and reducing means enabling the regeneration and if necessary the preparation of said composition.

According to one aspect of the invention therefore there is provided an industrial product comprising, on the one hand the composition according to the invention in the form of a concentrate in which the titanium is preferably in the trivalent state and, on the other hand a reducing means adapted to regenerate, by reduction of the tetravelent titanium into trivalent titanium, the composition prepared from the concentrate and, if necessary, to bring in a first stage the concentration of the composition in trivalent titanium to the desired value in the case where the starting concentrate is based on tetravelent titanim or contains too low a proportion of trivalent titanium.

DESCRIPTION OF PREFERRED EMBODIMENTS

The following Examples relate to preferred embodiments of the invention and show, by the combined results, the advantage of the latter.

EXAMPLE 1

Fifteen specimens constituted by panels of "cold rolled steel of the usual quality" 8/10 mm in thickness and measuring 150 mm×70 mm, were carefully degreased by means of trichlorethylene and then acetone; they were then subjected to a phosphating treatment by dipping.

For this treatment, a trade phosphating composition was used, particularly that known under the trademark "Duridine 49" ® and whose concentration was 3% by weight.

This composition contained phosphating agents and surface-active agents.

Its pH was 4.8 to 4.9.

It was used at 60° C.

The length of time of dipping these specimens in the phosphating composition was 10 minutes.

The covering obtained was an iron phosphate coating of which the weight of the layer varied between 0.2 and 0.3 g/m$^2$.

The fifteen specimens whose surface was thus phosphated were divided into three series of five.

The first series of Series (1) was subjected to no treatment intended to increase protection against corrosion; it was simply subjected to two successive rinsings, namely:

one rinsing with tap water:
time: 10 seconds by dipping
temperature: ambient, one rinsing with deionised water:
time: 30 seconds by dipping
temperature: ambient.

The second series of Series (2) was subjected to a chromating treatment. There followed successively:

rinsing with tap water:
time: 10 seconds by dipping
temperature: ambient, final rinsing in a chromic solution of pH equal to 3.4, which was prepared with deionised water and which contained 0.25 g/l of hexavalent chromium as well as 0.06 g/l of trivalent chromium:
time: 30 seconds by dipping
temperature: ambient.

one rinsing with deionised water:
time: 5 seconds by dipping
temperature: ambient.

The third series or Series (3) was subjected to the treatment according to the invention. There followed successively:

one rinsing with tap water:
time: 10 seconds by dipping
temperature: ambient, final rinsing in a solution of trivalent titanium chloride prepared by means of deionised water containing 0.33 g/l of trivalent titanium and whose pH was adjusted with soda to 3.4:
time: 30 seconds by dipping
temperature: ambient, one rinsing with deionised water:
time: 5 seconds by dipping
temperature: ambient.

The fifteen specimens so treated were dried in an oven at 150° C. for 5 minutes, then there was applied to them by dipping a water soluble paint (particularly that of the trademark BOUVET, reference: Satin black PRIMAIRE A6 No. 63 04 44) respecting the conditions stipulated by the supplier, namely:

viscosity: 25 to 30 seconds, measured with the Ford No. 4 cup,
pH: 8.8 to 9.2
draining time: 10 minutes
time and temperature of baking: 15 minutes at 160° C.

Three other sets of fifteen specimens were treated under the same conditions.

The specimens were then subjected to a corrosion test with 5% saline mist at a temperature of 35° C. under the conditions specified in ASTM standard B 117. After 96 hours of exposure to this saline mist, the results obtained were examined by using the ASTM standard D 1654-61. These results are indicated in Table I below; they represent the averages of the results of three series of tests carried out with the three sets of fifteen specimens.

TABLE I

| Series | Thickness of the paint layer applied (in microns) | Average failure after injury (scratch) (in millimeters) | Note on 10 |
|---|---|---|---|
| Series (1) (treated with deionised water) | 18 to 25 | 4 | 5.5 |
| Series (2) (chromating) | 18 to 25 | 0.4 | 9 |
| Series (3) (treated with a solution based on trivalent | 18 to 25 | 0.4 | 9 |

TABLE I-continued

| Series | Thickness of the paint layer applied (in microns) | Average failure after injury (scratch) (in millimeters) | Note on 10 |
|---|---|---|---|
| titanium | | | |

These results show that the specimens treated with a composition based on trivalent titanium manifest a resistance to corrosion equivalent to a conventional chromating treatment. This performance is all the more remarkable since the presence of the chloride ion introduced by the titanium chloride (III) is well known for its troublesome effect in this type of bath of the behaviour to corrosion.

EXAMPLE 2

Twenty-five specimens constituted by panels of "cold rolled steel of current quality" of 8/10 mm thickness and measuring 150 mm×70 mm, were used. These specimens were carefully degreased by means of trichlorethylene than acetone before being subjected to a phosphating conversion treatment by dipping.

This treatment is carried out with the same phosphating composition as in Example 1 and under the conditions described in this Example.

The coating obtained is an iron phosphate coating whose layer weight varies between 0.2 and 0.3 g/m$^2$. Five series of five specimens are formed which are treated as follows.

Series (1):
rinsing with tap water:
time: 10 seconds by dipping
temperature: ambient,
rinsing with deionised water:
time: 30 seconds by dipping
temperature: 60° C.

Series (2):
rinsing with tap water:
time: 10 seconds by dipping
temperature: ambient,
chromating in a chromic solution prepared from deionised water, which contains 0.25 g/l of hexavalent chromium and 0.06 g/l of trivalent chromium and whose pH is 3.4:
time: 30 seconds by dipping
temperature: 60° C.,
rinsing with deionised water:
time: 5 seconds by dipping
temperature: ambient.

Series (3):
rinsing with tap water:
time: 10 seconds by dipping
temperature: ambient,
treatment by final rinsing in a solution of potassium fluotitanate prepared from deionised water which contains 5 g/l of potassium fluotitanate (i.e. about 1 g/l of tetravalent titanium) and whose pH is adjusted to 4.5 with soda (NaOH):
time: 30 seconds by dipping
temperature: 60° C.,
rinsing with deionised water:
time: 5 seconds by dipping
temperature: ambient.

Series (4):
rinsing with tap water:
time: 10 seconds by dipping
temperature: ambient,
treatment by final rinsing in a solution of potassium fluotitanate and sodium hypophosphite prepared from deionised water containing 5 g/l of tetravalent titanium and 10 g/l of sodium hypophosphite with a pH adjusted to 4.5 with soda (NaOH):
time: 30 seconds by dipping
temperature: 60° C.,
rinsing with deionised water:
time: 5 seconds by dipping
temperature: ambient.

Series (5):
rinsing with tap water:
time: 10 seconds by dipping
temperature: ambient,
treatment according to the invention by final rinsing in a solution of trivalent titanium fluoride containing 0.3 g/l of trivalent titanium. This solution is prepared by dissolving 5 g of potassium fluotitanate and 10 g of sodium hypophosphite ($NaH_2PO_2$, $H_2O$) in a liter of deionised water, heating this mixture to 60° C. and circulating it in a closed circuit by means of a peristaltic pump over a column containing 30 g of zinc powder. By respecting a circulation flow rate of 0.7 l/hour, at the end of one hour a solution of pH=4.5 is obtained containing 0.3 g/l of trivalent titanium which can be used as such [the diagram of the device used is shown in FIG. 1) and the production curve of the trivalent titanium in FIG. 2].

The device shown in FIG. 1 comprises:

a vessel 1 containing heating means, for example a heating resistance 1*a*, as well as the composition 1*b* in which the treatment is carried out, means for reducing the tetravalent titanium into trivalent titanium comprising a metallic reducer R placed inside a column 2 fixed to a support 3 so as to open above the composition 1*b*, a pump 4 connected by a pipe 5 to the bottom of the vessel 1 and by a pipe 6 to the top of the column 2 and adapted to take up in the vessel 1 a fraction of the composition 1*b* and to pass it through the column 2.

Figure 2:
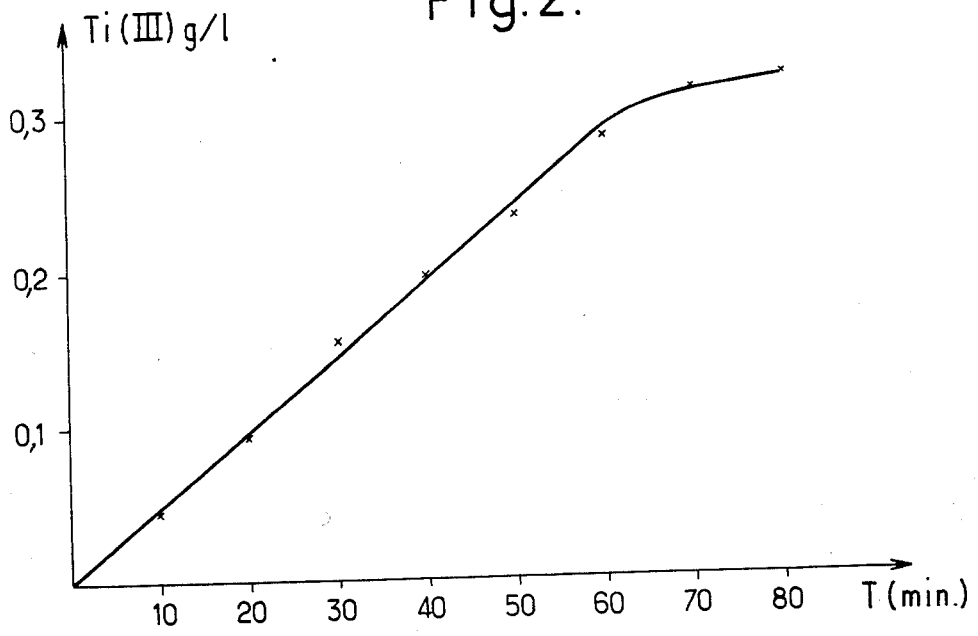

The curve C shown in FIG. 2 illustrates the variation of the content of the bath in grams of Ti(III) per liter of composition (ordinates axis) as a function of the time T expressed in minutes during which the recycling is maintained (abscissae axis) under the conditions which have just been specified.

The treatment in this solution is as follows:
times: 30 seconds by dipping
temperature: 60° C.,
rinsing with deionised water:
time: 5 seconds by dipping
temperature: ambient.

The specimens thus prepared are dried in an oven at 150° C. for 5 minutes, then there is applied to them by dipping the water soluble paint of Example 1 respecting the conditions described in this Example.

The specimens are then subjected to a corrosion test with 5% saline mist at a temperature of 35° C. under the conditions specified in the standard ASTM B 117. After 96 hours of exposure to said saline mist, the results obtained in accordance with the ASTM standard D 1654-61 are examined. These results are indicated in Table II below; they represent the averages of the results of the tests carried out on the three sets of twenty-five specimens.

TABLE II

| Series | Thickness of the paint layer applied (in microns) | Average failure from injury (in millimeters) | Note on 10 |
|---|---|---|---|
| Series (1) (treated with deionised water) | 18 to 25 | 4 | 5.5 |
| Series (2) (chromating) | 18 to 25 | 0.4 | 9 |
| Series (3) (treated with a solution of potassium fluotitanate) | 18 to 25 | 2.5 | 6.5 |
| Series (4) (treated with a solution of potassium fluotitanate and sodium hypophosphite) | 18 to 25 | 2.5 | 6.5 |
| Series (5) (treated with a solution of trivalent titanium) | 18 to 25 | 0.4 | 9 |

These results show that, as soon as the composition contains a sufficient amount of trivalent titanium, the anticorrosion performance becomes equivalent to that of a conventional chromic rinsing.

EXAMPLE 3

Three series of five specimens constituted by panels of "cold rolled steel of current quality" of 8/10 mm in thickness and measuring 150×70 mm, were carefully degreased with trichlorethylene and then with acetone before being subjected to the following treatments:

jet degreasing by means of an alkaline degreasing composition, particularly that which is marketed under the trademark "Ridoline 910" and of which
- the use concentration is 1% by weight,
- the temperature of use 60° C. and,
- the duration of the treatment 90 seconds,
- the application pressure being 1.5 bar, rinsing with tap water:
- time: 10 seconds by dipping
- temperature: ambient, phosphating conversion by a jet by means of a phosphating solution, particularly marketed under the trademark "Granodine 16" of which
- the concentration of the phosphating and surface-active agents was 1.6% by volume,
- the application temperature 55° C.,
- the time of application 1 minute and
- pressure 0.8 bar.

A zinc phosphate coating was obtained of which the layer weight varied between 2 and 3 g/m$^2$.

The three series of five specimens were then treated respectively like the three series of five specimens of Example 1.

After drying and application of the water-soluble paint under the conditions of Example 1, the three series of specimens were treated in the manner described in ASTM standard B 117. After 384 hours of exposure of saline mist, the results obtained by using the ASTM standard 1654-61 were examined. These results are indicated in Table III below: they represent the averages of the results of three tests, that is to say of the tests carried out with three sets of three series of five specimens.

TABLE III

| Series | Thickness of the paint layer applied (in microns) | Average failure from injury (in millimeters) | Note on 10 |
|---|---|---|---|
| Series (1) (treated with deionised water) | 18 to 25 | 5 | 4 |
| Series (2) (chromating) | 18 to 25 | 0 | 10 |
| Series (3) (treated with a solution based on trivalent titanium) | 18 to 25 | 0 | 10 |

The results confirm the conclusions formed in Example 1.

EXAMPLE 4

Specimens were again used constituted by panels of "cold rolled steel of current quality" of 8/10 mm thickness and measuring 150×70 mm. These specimens were carefully degreased with trichlorethylene then with acetone before being treated as follows:

degreasing by a jet by means of an alkaline degreasing composition under the conditions of Example 3, rinsing with tap water:
- time: 10 seconds by dipping
- temperature: ambient, phosphating conversion by jet under the conditions of Example 3.

A zinc phosphate coating was obtained of which the layer weight varies between 2 and 3 g/m$^2$.

Three sets of five series of five specimens were treated under the condition of Example 2.

All the specimens were subjected to the saline mist test (ASTM standard B 117). After 384 hours of saline mist the results obtained were examined, by using the data of the ASTM standard D 1654-61. These results are indicated in Table IV below: they show the averages of the results obtained with the three sets.

TABLE IV

| Series | Thickness of the paint layer applied (in microns) | Average failure from injury (in millimeters) | Note on 10 |
|---|---|---|---|
| Series (1) (treated with deionised water) | 18 to 25 | 5 | 4.5 |
| Series (2) (chromating) | 18 to 25 | 0 | 10 |
| Series (3) (treated with a potassium fluotitanate solution) | 18 to 25 | 3 | 6 |
| Series (4) (treated with a potassium fluotitanate and sodium hypophosphite solution) | 18 to 25 | 3 | 6 |
| Series (5) (treated with a trivalent titanium solution) | 18 to 25 | 0 | 10 |

These results confirm the conclusions formulated in Example 2.

There is thus provided, whatever the embodiment adopted, a composition and a process of treatment of phosphatised metal surfaces of which the characteristics and the advantages result clearly from the foregoing.

As is self-evident and as emerges already from the foregoing, the invention is in no way limited to those of its types of application and embodiments which have been more particularly envisaged; it encompasses, on the contrary, all modifications.

We claim:

1. Process for the treatment of phosphatised metallic surfaces, wherein, before the possible application of a paint layer, the phosphatised metal surface is treated by contacting said surface with a composition comprising an effective amount of a solution of trivalent titanium, said solution having a pH in the acid range, for a period of time sufficient to confer on the treated surface the desired resistance to corrosion.

2. Process according to claim 1, comprising dipping the surface to be treated in said composition.

3. Process according to claim 2, wherein the dipping time is from 10 to 60 seconds and the temperature of the composition is below 90° C.

4. Process according to claim 3, wherein said temperature is between 18° and 60° C.

* * * * *